US007997249B2

(12) United States Patent
Matsui et al.

(10) Patent No.: US 7,997,249 B2
(45) Date of Patent: Aug. 16, 2011

(54) PISTON FOR INTERNAL COMBUSTION ENGINE AND INTERNAL COMBUSTION ENGINE WITH THE SAME

(75) Inventors: Jun Matsui, Toyota (JP); Kenji Hayama, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 544 days.

(21) Appl. No.: 12/226,205

(22) PCT Filed: May 21, 2007

(86) PCT No.: PCT/IB2007/001302

§ 371 (c)(1),
(2), (4) Date: Oct. 10, 2008

(87) PCT Pub. No.: WO2007/135534

PCT Pub. Date: Nov. 29, 2007

(65) Prior Publication Data

US 2009/0151688 A1 Jun. 18, 2009

(30) Foreign Application Priority Data

May 22, 2006 (JP) ..... 2006-141263

(51) Int. Cl.
*F02F 3/00* (2006.01)

(52) U.S. Cl. ..... 123/193.6; 123/193.1; 123/46 R; 123/46 SC; 123/41.35

(58) Field of Classification Search ..... 123/193.6, 123/193.1, 46 R, 46 SC, 41.35
See application file for complete search history.

(56) References Cited

U.S. PATENT DOCUMENTS

| | | | | |
|---|---|---|---|---|
| 5,052,280 | A | 10/1991 | Kopf et al. | |
| 5,144,923 | A | 9/1992 | Leites et al. | |
| 5,839,407 | A * | 11/1998 | Suzuki et al. | 123/193.6 |
| 6,668,703 | B2 * | 12/2003 | Gamble | 92/186 |
| 2002/0023609 | A1 * | 2/2002 | Laimbock | 123/193.6 |
| 2002/0178909 | A1 * | 12/2002 | Nomura et al. | 92/208 |
| 2004/0237775 | A1 * | 12/2004 | Dunaevsky et al. | 92/160 |

FOREIGN PATENT DOCUMENTS

| | | |
|---|---|---|
| EP | 0 064 831 A2 | 11/1982 |
| FR | 2 660 699 A1 | 10/1991 |
| JP | U-2-87943 | 7/1990 |
| JP | U-3-27856 | 3/1991 |
| JP | U-3-102042 | 10/1991 |
| JP | U-7-17937 | 3/1995 |
| JP | A-10-141134 | 5/1998 |
| JP | B2-3065118 | 7/2000 |
| JP | A-2000-240509 | 9/2000 |
| JP | A-2004-225596 | 8/2004 |
| JP | A-2004-285942 | 10/2004 |

* cited by examiner

*Primary Examiner* — Michael Cuff
*Assistant Examiner* — James Kim
(74) *Attorney, Agent, or Firm* — Oliff & Berridge, PLC

(57) ABSTRACT

A piston for an internal combustion engine including: a piston head located at an uppermost section of the piston; a land located on a circumference of the piston head; a skirt located below the land; and a pair of pin bosses located on the lower section of the piston head. The piston head has a first cavity on the bottom of the piston head. Each of the pair of pin bosses has a second cavity in an outer upper section of the pin boss. The pin boss has a through hole that communicably connects the first cavity with the second cavity.

7 Claims, 4 Drawing Sheets

PISTON FOR INTERNAL COMBUSTION ENGINE AND INTERNAL COMBUSTION ENGINE WITH THE SAME

BACKGROUND OF THE INVENTION

1. Field of the Invention

The present invention relates to a cooling structure for a piston in an internal combustion engine. The invention also relates to an internal combustion engine provided with the piston having such cooling structure.

2. Description of the Related Art

A piston for an internal combustion engine (hereinafter sometimes simply referred to as "piston") reciprocates within a cylinder bore when combustion occurs in the engine. Thus, the piston is required to not only be rigid enough to withstand high-speed motions and heat deformation, but also be light and have lubrication and cooling performance. For instance, the related art described in the Japanese Utility Model application publication No. JP-U-7-17937 offers the piston having a reduced weight, and improved lubrication and cooling performance.

The piston described in the Japanese Utility Model application publication No. JP-U-7-17937 has recesses formed in the forward (Fr) and rearward (Rr) portions (toward the front and the rear of the engine, respectively) of the piston to reduce the weight of the piston. Each weight-reducing recess is formed by molding in the outer upper section of a pin boss. The pin boss has an insertion hole for a piton pin. The piston has additional recesses in the pin boss, which are opened to the respective weight-reducing recesses. These weight-reducing recesses in the piston and recesses in the pin boss are provided to reduce the weight of the piston.

Oil is sprayed from an oil jet and delivered to the weight-reducing recesses and the pin boss recesses to cool the piston. Also, each pin boss recess is communicated with the piston pin hole in the pin boss to direct the oil delivered to the pin boss recess to the piston pin hole for lubricating the piston pin.

As described above, the piston has the weight-reducing recesses in its Fr and Rr portions. However, in an attempt to cool this piston using the oil delivered from the oil jet to the undersurface of the piston head, the weight-reducing recesses prevent heat from flowing. This results in a drawback of insufficient cooling of areas surrounding the weight-reducing recesses, and therefore, an increase in temperature in such areas. More specifically, the areas surrounding the weight-reducing recesses include the Fr and Rr portions of a land into which a piston ring is fitted, and the Fr and Rr circumferential portions of the piston head or the uppermost section of the piston.

The Japanese Utility Model application publication No. JP-U-7-17937 also describes that the oil is sprayed from the oil jet and splashed directly onto the weight-reducing recesses in the piston, thereby effectively cooling the area surrounding the weight-reducing recesses, and therefore cooling the entire piston. In this case, however, an individual oil jet is required to cool each of the areas surrounding the weight-reducing recesses formed respectively in the Fr and Rr portions of the piston. Therefore, two oil jets are required per piston. This increases the number of the components used in the piston, and thus increases the load on the oil pump undesirably.

SUMMARY OF THE INVENTION

The present invention provides a piston for an internal combustion engine having respective molded cavity portions on forward and rearward sides of the piston. The piston has a cooling structure for cooling areas surrounding the molded cavity portions sufficiently, while reducing the number of components and the load on an oil pump. The present invention also provides an internal combustion engine having this piston.

A first aspect of the invention is directed to a piston for an internal combustion engine, including: a piston head located at an uppermost section of the piston, having a first cavity on the bottom of the piston head; a land located around the circumference of the piston head; a skirt located below the land; and a pair of pin bosses located on the lower section of the piston head, in which a second cavity is formed in an outer upper section of the pin boss. The piston for an internal combustion engine is characterized in that each pin bosses has a through hole formed on an upper section of the pin boss that communicably connects the first cavity with the second cavity.

The piston thus constructed allows oil, which is sprayed from an oil jet and splashed onto the undersurface of the piston head, to diffuse in the first cavity on the undersurface of the piston head. Thereby, first the oil cools the piston head of the piston on the undersurface, and then cools portions of the land in a thrust (Th) direction and an anti-thrust (ATh) direction, the skirt, and the pin bosses. Part of the oil, which is splashed onto the undersurface of the piston head, diffuses and flows through the through hole into the second cavity. Thus, the oil cools an area surrounding the second cavity in the piston. To be more specific, the area includes forward (Fr) and rearward (Rr) portions of the land (toward the front and the rear of the engine, respectively) as well as Fr and Rr circumferential portions of the piston head. This prevents a decrease in cooling performance in the area surrounding the second cavity. Consequently, the entire piston is effectively cooled, thereby improving the cooling of the piston.

In addition, cooling of the area surrounding the second cavity is achieved using a single oil jet. This eliminates the necessity of providing a separate oil jets for cooling the area surrounding the second cavity. Accordingly, the number of components used in the piston is reduced, thereby reducing the load on the oil pump.

According to the first aspect, the through hole may be angled in the axial direction of the piston. This helps oil flow toward the second cavity, thereby delivering the oil to the second cavity efficiently, and thus cooling the area surrounding the second cavity efficiently.

In addition, according to the first aspect, the land may be provided with an oil return hole to communicate with the second cavity, and the through hole and the oil return hole may be located along a common straight line. This enables the through hole and the oil return hole to be machined simultaneously with a single boring process. Such simplified boring process for forming the through hole and the oil return hole facilitates production of the piston, and therefore improves the productivity thereof. An oil ring is fitted into the land. Oil scraped off by the oil ring returns to the second cavity through the oil return hole, cooling the area surrounding the second cavity. This further prevents a decrease in cooling performance in the area surrounding the second cavity. Consequently, the entire piston is effectively cooled, thereby improving the cooling performance in the piston.

A second aspect of the invention is directed to an internal combustion engine. The internal combustion engine includes: the piston for an internal combustion engine according to the first aspect; and an oil jet for spraying oil toward the undersurface of the piston head of the piston for an internal combustion engine. The internal combustion engine thus constructed allows oil, which is sprayed from an oil jet and splashed onto the undersurface of the piston head, to diffuse in the first cavity on the undersurface of the piston head. At the same time, part of the diffusing oil flows through the through hole into the second cavity, thereby cooling the area surrounding the second cavity in the internal combustion engine. This prevents the internal combustion engine from decreasing the cooling performance in the area surrounding the second cavity.

According to the second aspect, the through hole may be provided radially from a center or location on the undersurface of the piston head onto which the oil is sprayed from the oil jet. The through hole thus constructed ensures that the oil sprayed from the oil jet onto the undersurface of the piston head passes through the through hole and is delivered to the second cavity. This allows the internal combustion engine to effectively cool the area surrounding the second cavity, while effectively preventing the internal combustion engine from decreasing the cooling performance in the areas surrounding the second cavity.

According to any one of the first and the second aspects, part of the oil, which is splashed onto the undersurface of the piston head of the piston, diffuses and flows through the through hole into the second cavity, thereby cooling the area surrounding the second cavity. This prevents a decrease in cooling performance in the area surrounding the second cavity. Consequently, the entire piston is effectively cooled, thereby improving the cooling performance in the piston.

In addition, cooling of an area surrounding a second cavity is achieved by a single unit of the oil jet. This eliminates the necessity of providing an individual oil jet for cooling each area surrounding the second cavity. Accordingly, the number of components used in the piston decreases, thereby reducing the load on the oil pump.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF THE EXAMPLE EMBODIMENTS

A first and a second embodiment of the invention will be described below with reference to accompanying drawings.

Figure 1:
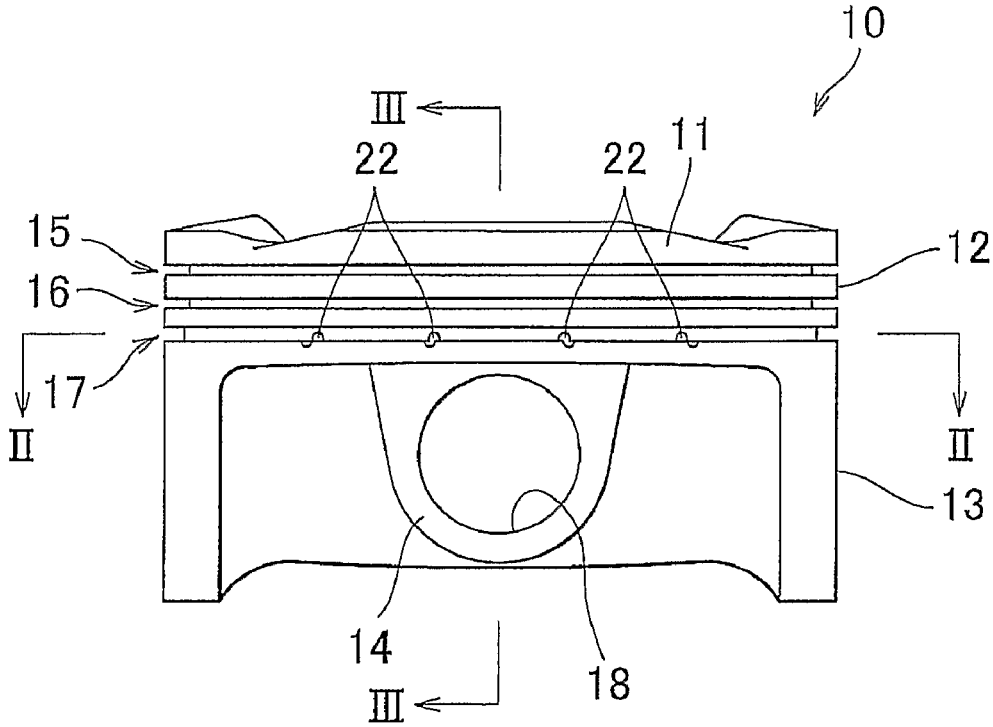
FIG. 1 is a side view of a piston for an internal combustion engine according to a first embodiment of the invention.
Figure 2:
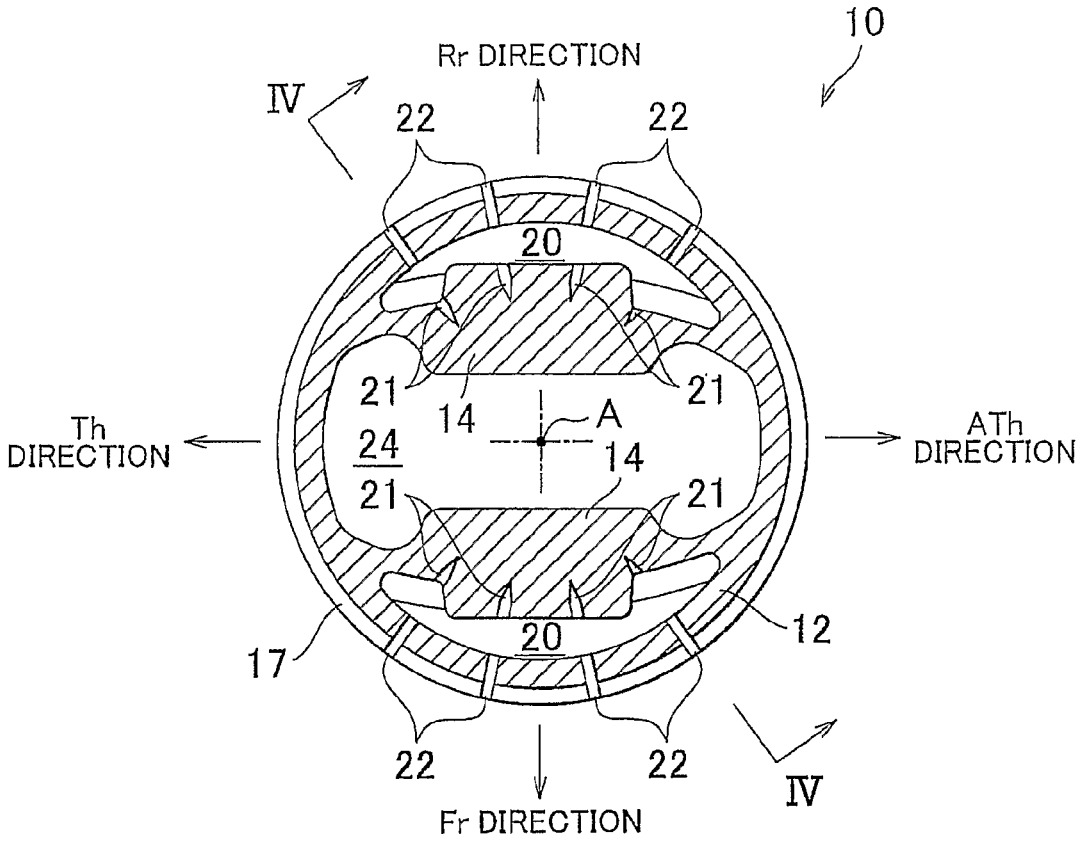
FIG. 2 is a sectional view taken along the line II-II in FIG. 1.
Figure 3:
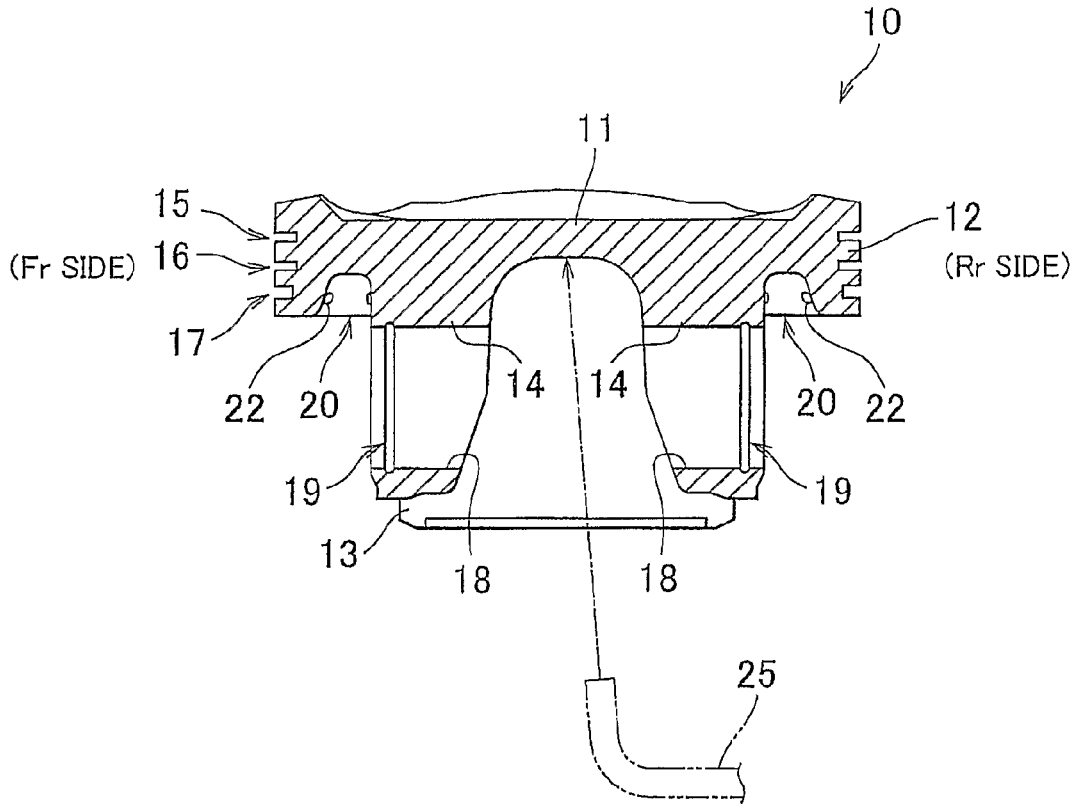
FIG. 3 is a sectional view taken along the line III-III in FIG. 1.
Figure 4:
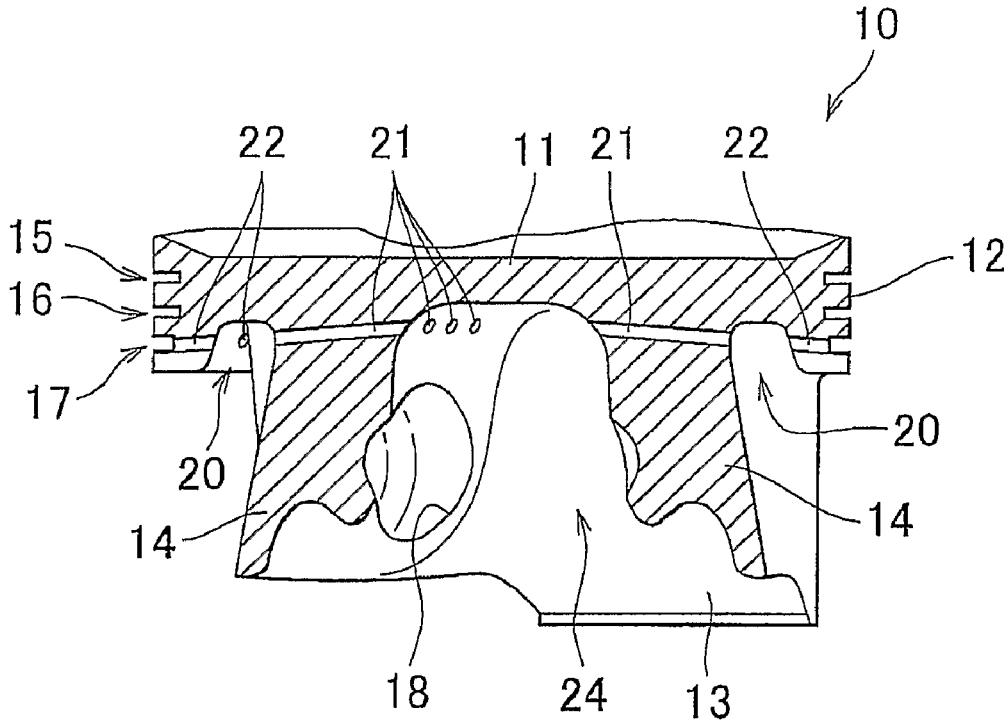
FIG. 4 is a sectional view taken along the line IV-IV in FIG. 2.

FIG. 1 is a side view of a piston for an internal combustion engine according to the first embodiment of the invention, as viewed from the front (Fr) of the engine. FIG. 2 is a sectional view taken along the line II-II in FIG. 1. FIG. 3 is a sectional view taken along the line III-III in FIG. 1. FIG. 4 is a sectional view taken along the line IV-IV in FIG. 2. As shown in FIG. 2 and others, the direction, in which a piston pin inserted into a piston pin hole extends (the direction in which a crankshaft, connected to the piston through a connecting rod, extends), is designated as forward (Fr) direction and rearward (Rr) direction of the engine. The direction perpendicular to the Fr-Rr direction is designated as thrust (Th) direction and anti-thrust (ATh) direction. FIG. 3 shows the piston and an oil jet.

An internal combustion engine according to the second embodiment of the invention has a piston 10, which will be described later in details, and an oil jet 25 provided below the piston 10.

As shown in FIG. 1, the piston 10 according to the first embodiment reciprocates within a cylinder bore when combustion occurs in the internal combustion engine. The piston 10 includes a piston head 11 located at the uppermost section of the piston 10, a land 12 located around a circumference of the piston head 11, a skirt 13 located below the land 12, and a pair of pin bosses 14 located on the lower section of the piston head 11. The piston 10 is made of light metal having excellent thermal conductivity, such as aluminum alloy, and has specified rigidity.

A top surface (outer surface) of the piston head 11 of the piston 10 defines a part of a combustion chamber of the internal combustion engine. As shown in FIG. 3, oil is sprayed from the oil jet 25 and splashed directly onto an undersurface (inner surface) of the piston head 11, as will be described later.

As shown in FIG. 1, the land 12 has outer peripheral piston ring grooves 15, 16, 17 into which respective piston rings are fitted. Compression rings are fitted into the two grooves 15 and 16, which are located closer to the piston head 11. The compression rings are designed to prevent gas from leaking. An oil ring is fitted into the piston ring groove 17 located closer to the skirt 13. The oil ring is designed to scrape oil off an inner wall of the cylinder bore of the internal combustion engine. The land 12 has plural oil return holes 22 extending through the interior of the piston ring groove 17. The piston ring groove 17 communicates with molded cavity portions (weight-reducing cavities) 20 through the oil return holes 22. This allows the oil scraped off by the oil ring to be effectively collected.

As shown in FIG. 3, the skirt 13 has Fr and Rr notched portions. In other words, the skirt 13 is not cylindrical, but is notched on the Fr and Rr sides to reduce weight and friction loss.

As shown in FIG. 2, the pair of pin bosses 14 support the piston pin, and face each other with respect to a center point A in a plan view of the piston 10. In this embodiment, the piston bosses 14 are provided respectively in the Fr and Rr portions of the piston 10. The piston bosses 14 have associated piton pin holes 18 into which the piston pin is fitted. Each piston pin hole 18 has a retaining groove 19 at its outer end opening. A snap ring, such as circlip, is fitted into the retaining groove 19 to prevent the piston pin from slipping off. A connecting rod includes a big- and a small-end cylindrical portion. The piston 10 is coupled with the small-end cylindrical portion through the piston pin fitted into the piston pin holes 18 of the pair of the piston bosses 14. The big-end cylindrical portion is coupled to a crankshaft. The piston 10 has a weight-reducing cavity internally between the pair of pin bosses 14, in which the small-end cylindrical portion is located. The weight-reducing cavity is provided on the undersurface of the piston head 11, and enclosed by the undersurface of the piston head 11, the inner wall of the skirt 13, the inner walls of the pin bosses 14, and other parts. The cavity thus enclosed is hereinafter referred to as weight-reducing space 24.

The pin bosses 14 have the respective molded cavity portions 20 in the outer upper section. The molded cavity portions 20 are formed between the outer upper section of the pin boss 14 and the land 12 on the Fr and Rr sides, respectively. As described above, in order to reduce the weight of the piston 10, the weight-reducing cavities or the molded cavity portions are formed by molding in the Fr and Rr portions of the piston 10. The embodiment of the invention forms the weight-reducing cavities or the molded cavity portions by molding between the outer upper section of the pin boss 14 and the land 12 on the Fr and Rr sides of the piston, respectively. However, the invention is not limited to this embodiment. Alternatively, the weight-reducing cavities or the molded cavity portions may be formed by cutting the Fr and Rr portions of the piston between the outer upper section of the piston boss 14 and the land 12.

As shown in FIGS. 2 and 4, each pin boss 14 has through holes 21 formed in its upper section. The through holes 21 allow the molded cavity portions 20 to communicate with the weight-reducing space 24. Each through hole 21 is angled such that a part of the through hole 21 closer to the molded cavity portion 20 is positioned lower than the other part of the through hole 21 closer to the weight-reducing space 24. The through holes 21 serve as an oil supply passage for directing oil from the oil jet 25 to the molded cavity portions 20, as will be discussed later (see FIG. 3).

The positional relationship between the through hole 21 of the piston boss 14 and the corresponding oil return hole 22 of the land 12 is now described with reference to FIG. 4. The through hole 21 and the oil return hole 22 are provided along a straight line extending radially outward of the piston 10 from the center point A. In other words, the through hole 21 and the oil return hole 22 are radially formed from the center point A, or these holes may be located along a common straight line. As shown in FIG. 2, the four through holes 21 are provided for each pin boss 14 at intervals of a given angle in a plan view. In the embodiment of the invention, the four oil return holes 22 are provided respectively in the Fr and Rr portions of the land 12 at intervals of a given angle in a plan view. In addition, the through hole 21 has a diameter equal to the diameter of the oil return hole 22.

As shown in FIG. 4, the holes 21 and the oil return holes 22 are formed in the piston 10 in the above positional relationship. This enables each through hole 21 and corresponding oil return hole 22 to be machined simultaneously with a single boring process. For a specific example, the piston 10 may be drilled from the outside of the land 12 toward the center point A, such that the oil return hole 22 is formed through the land 12, while the through hole 21 is formed through the pin boss 14. The simplified boring process for forming the through holes 21 and the oil return holes 22 facilitates production of the piston 10, and therefore improves the productivity thereof.

To form the through holes 21 in accordance with the above positional relationship, drilling the piston 10 from the outside of the land 12 toward the center point A is likely to be the easiest. The boring process must result in simultaneous formation of the through hole 21 in the pin boss 14 and its corresponding through hole in the land 12. In this embodiment, such a through hole formed in the land 12 is used as the aforementioned oil return hole 22.

The piston 10 thus constructed is cooled with oil sprayed from the oil jet 25 located below the piston 10. How to cool the piston 10 in the internal combustion engine is described below with reference to FIG. 3.

The oil jet 25 sprays oil toward the approximate center of the undersurface of the piston head 11 of the piston 10. The oil sprayed from the oil jet 25 splashes onto the undersurface of the piston head 11, and then diffuses in the weight-reducing space 24. Thereby, the oil cools the area surrounding the weight-reducing space 24. To be more specific, first the oil cools the piston head 11 of the undersurface of the piston 10, and then cools the Th and Ath portions of the land 12, the skirt 13 and the pin bosses 14 in sequence. Part of the diffusing oil, splashed onto the undersurface of the piston head 11, flows through the through holes 21 into the associated molded cavity portions 20. Thereby, this oil cools the areas surrounding the molded cavity portions 20, and more specifically, cools the Fr and Rr portions of the land 12 as well as the Fr and Rr circumferential portions of the piston head 11.

Assuming that no through holes 21 are provided in the pin bosses 14, the molded cavity portions 20 prevent heat from flowing, which can reduce the cooling of the areas surrounding the molded cavity portions 20. In this embodiment, as shown in FIG. 4, oil is delivered to the molded cavity portions 20 through the through holes 21 in an active manner to cool the areas surrounding the molded cavity portions 20. This prevents the internal combustion engine from decreasing the cooling performance in the areas surrounding the molded cavity portions 20 in the piston 10. Consequently, the entire piston 10 is effectively cooled in the internal combustion engine, thereby improving the cooling of the piston.

The through holes 21 are radially provided approximately from a center or location on the undersurface of the piston head 11 onto which the oil is sprayed from the oil jet 25. This ensures that the oil, which is sprayed from the oil jet 25 onto the undersurface of the piston head 11, passes through the through holes 21 and is delivered to the molded cavity portions 20. This allows the internal combustion engine to effectively cool the areas surrounding the molded cavity portions 20 in the piston 10, while effectively preventing the internal combustion engine from decreasing the cooling performance in the areas surrounding the molded cavity portions 20 in the piston 10.

As shown in FIG. 4, the through holes 21 are angled in the aforementioned manner, which helps oil flow from the weight-reducing space 24 toward the molded cavity portions 20. Thereby, the oil is delivered efficiently via the through holes 21 to the molded cavity portions 20, and the areas surrounding the molded cavity portions 20 in the piston 10 are cooled efficiently. In addition, cooling of the areas surrounding the molded cavity portions 20 is achieved using a single oil jet 25. This eliminates the necessity of providing the internal combustion engine with a separate oil jet for cooling the respective areas surrounding the molded cavity portions 20. Accordingly, the number of components used in the piston decreases, thereby reducing the load on the oil pump.

Further, the piston 10 is cooled with additional oil, which is scraped off by the oil ring fitted into the piston ring groove 17 of the land 12 and then flows back to the molded cavity portions 20 through the oil return holes 22. As shown in FIG. 2, while the oil return holes 22 are provided respectively in the Fr and Rr portions of the land 12, no oil return holes 22 are provided in any Th and ATh portions of the land 12. Thus, oil flows into the oil return holes 22 not only from the Fr and Rr portions of the inner wall of the cylinder bore, but also from the Th and ATh portions thereof.

If additional oil return holes are provided in the Th and ATh portions of the land 12, part of oil would return to the molded cavity portions 20 through the additional oil return holes. However, such oil hardly contributes to cooling of the areas surrounding the molded cavity portions 20. In this embodiment, the oil return holes 22 are provided only in the Fr and Rr portions of the land 12, through which most of the oil scraped off by the oil ring returns to the molded cavity portions 20. This prevents the cooling performance in the areas surrounding the molded cavity portions 20 in the piston 10 from deteriorating. Consequently, the entire piston 10 is effectively cooled in the internal combustion engine, thereby improving the cooling of the piston.

The number of the through holes 21 per pin boss 14, the diameter of the through hole, and the angle at which the through hole is disposed are not limited to those described in the embodiment of the invention. They may be determined as appropriate, taking into account the cooling of the areas surrounding the molded cavity portions 20 in the piston 10. The diameters of the through holes 21 do not have to be equal. In addition, it is not necessary to dispose the through holes 21 at equal angles. In other words, the diameter and angle may be determined for the individual through holes 21 as appropriate to the respective locations thereof.

In the above embodiment, the number of the through holes 21 is equal to the number of the oil return holes 22. Alternatively, the number of the oil return holes 22 may be greater than the number of the through holes 21. In addition, the through hole 21 has a diameter equal to the diameter of the oil return hole 22 in the above embodiment. Alternatively, the oil return hole 22 may have a larger diameter than the diameter of the through hole 21.

As described in the above embodiment, oil is sprayed from the oil jet 25 toward the approximate center of the undersurface of the piston head 10 of the piston 10. Alternatively, oil may be sprayed in any direction other than the aforementioned direction. If the oil is sprayed a different direction, the through holes 21 may be formed in the pin bosses 14 radially approximately from a center or location on the undersurface of the piston head 11 onto which the oil is sprayed from the oil jet 25. This effectively ensures that the oil passes through the through holes 21 and is delivered to the molded cavity portions 20 as in the above embodiment.

The invention claimed is:

1. A piston for an internal combustion engine comprising:

a piston head located at an uppermost section of the piston, having a first cavity on the bottom of the piston head;

a land located around a circumference of the piston head;

a skirt located below the land; and a pair of pin bosses located on the lower section of the head, in which a second cavity is formed in an outer upper section of the pin boss, wherein each pin boss has a through hole formed on an upper section of the pin boss that communicably connects the first cavity with the second cavity, and wherein the land is provided with an oil return hole that communicates with the second cavity, and the through hole is provided on a common axis with the oil return hole.

2. The piston for an internal combustion engine according to claim 1, wherein the land is provided with an oil return hole that communicates with the second cavity, and the number of the oil return holes is larger than the number of the through holes.

3. The piston for an internal combustion engine according to claim 1, wherein the second cavity is provided in forward and rearward portions of the piston.

4. The piston for an internal combustion engine according to claim 1, wherein the oil return hole is provided in forward and rearward portions of the piston.

5. The piston for an internal combustion engine according to claim 1, wherein the through hole is provided radially from the center of the piston head.

6. An internal combustion engine comprising:

a piston for an internal combustion engine comprising:

a piston head located at an uppermost section of the piston, having a first cavity on the bottom of the piston head;

a land located around a circumference of the piston head;

a skirt located below the land; and a pair of pin bosses located on the lower section of the head, in which a second cavity is formed in an outer upper section of the pin boss, wherein each pin boss has a through hole formed on an upper section of the pin boss that communicably connects the first cavity with the second cavity, and wherein the land is provided with an oil return hole that communicates with the second cavity, and the through hole is provided on a common axis with the oil return hole; and an oil spraying device that sprays oil toward the undersurface of the piston head of the piston.

7. The internal combustion engine according to claim 6, wherein the through hole is provided radially from the center of the piston head or a location on the bottom of the piston head onto which the oil is sprayed from the oil spraying device.

* * * * *